US005624042A

United States Patent [19]

Flum et al.

[11] Patent Number: 5,624,042

[45] Date of Patent: Apr. 29, 1997

[54] VARIABLE WIDTH PRODUCT MERCHANDISING DISPLAY UNIT HAVING DETACHABLE/REATTACHABLE SIDE TRACK PORTIONS

[75] Inventors: Paul L. Flum, Ladue; Dewalt W. Fowler, Manchester, both of Mo.; Donald J. Miller, Jr., Belleville, Ill.

[73] Assignee: Paul Flum Ideas, Inc., St. Louis, Mo.

[21] Appl. No.: 259,889

[22] Filed: Jun. 15, 1994

[51] Int. Cl.[6] ..... A47F 1/04

[52] U.S. Cl. ..... 211/59.2; 211/153; 211/126.1; 312/42; 403/334

[58] Field of Search ..... 211/59.2, 175, 211/174, 74, 153, 186, 126, 184; 248/909; 312/42; 403/381, 333, 334

[56] References Cited

U.S. PATENT DOCUMENTS

| | | | |
|---|---|---|---|
| 3,037,593 | 6/1962 | Webster | 403/381 X |
| 4,019,298 | 4/1977 | Johnson, IV | 403/381 X |
| 4,416,380 | 11/1983 | Flum | 211/194 X |
| 4,454,949 | 6/1984 | Flum | 211/126 X |
| 4,724,968 | 2/1988 | Wombacher | 211/184 X |
| 4,801,025 | 1/1989 | Flum et al. | 211/59.2 X |
| 4,867,598 | 9/1989 | Winter, IV | 403/381 |
| 4,971,209 | 11/1990 | Todd | 211/74 |
| 5,024,336 | 6/1991 | Spamer | 211/59.2 |
| 5,050,748 | 9/1991 | Taub | 211/59.2 |
| 5,341,945 | 8/1994 | Gibson | 41/184 |
| 5,351,838 | 10/1994 | Flum | 211/59.2 |

*Primary Examiner*—Korie Chan
*Attorney, Agent, or Firm*—Haverstock, Garrett & Roberts

[57] ABSTRACT

A product support module adaptable for interlocking engagement with substantially similarly constructed modules to form a selectable width composite display assembly for merchandising products therefrom, each product module including a plurality of friction keeper members associated with one side edge portion of the module and a plurality of corresponding keying slots associated with its opposite side edge portion, the keeper members being substantially T-shaped in cross-section and each including a stem portion and an overhanging flange portion, the stem portion associated with at least the front keeper member being outwardly tapered along its entire length from bottom to top such that the mating surface formed between the stem portion and the overhanging flange portion forms an angle with the front wall side portion of the module. The taper associated with at least the front keeper stem portion enables its corresponding slot to become progressively tighter as the slot is moved progressively downwardly over the front keeper stem portion. The thickness of the wall portion forming the front keying slot may likewise be similarly tapered from bottom to top so as to be compatible with the taper associated with the front keeper stem portion to further improve the locking capability therebetween. Still further, other keeper members as well as their corresponding keying slots may likewise be tapered in similar fashion so as to even further improve the stability and joinder between two adjacent modules when such modules are coupled together. Each product module may vary both in lateral width and in the number of product channels associated therewith and some embodiments of the present product modules may include no side wall members or only one side wall member depending upon the particular merchandising application. Other optional features associated with the present product modules are likewise disclosed herein. The present product modules represent a one-inventory solution to a user enabling such user to organize and configure any particular shelf display to meet his/her specific needs and space requirements.

48 Claims, 5 Drawing Sheets

VARIABLE WIDTH PRODUCT MERCHANDISING DISPLAY UNIT HAVING DETACHABLE/REATTACHABLE SIDE TRACK PORTIONS

The present invention relates generally to product display devices for use in storing and merchandising shelved products therefrom and, more particularly, to various embodiments of an adjustable product merchandising display unit which comprises a plurality of product modules which can be assembled in columnar array to achieve any desired width and any desired number of product channels depending upon the particular merchandising application. The present assemblies can be conveniently supported in a flat horizontal position or in an inclined position for gravity feeding products positioned thereon, some embodiments including a frangible rear portion which allow the depth of each such product module to be adjusted so as to likewise provide shelf depth adjustment capability. The subject devices are ideally suited for use on conventional shelving commonly utilized in supermarkets, convenience stores, and other food and beverage outlets including refrigerated coolers and, although the subject units are primarily designed for use in a wide variety of refrigerated display cases presently utilized in the marketplace, they are likewise adaptable for use in many display shelf applications.

BACKGROUND OF THE INVENTION

It is a common practice to provide a rack structure to organize and merchandise shelved products to customers. This is particularly true with respect to displaying and merchandising chilled soft drink products in conventional refrigerated display coolers. Since the advent of the larger product containers such as the twenty ounce and one liter product containers commonly used in the soft drink industry, it has become more and more difficult to fit many of the prior art shelving devices within the allotted space associated with the known refrigerated coolers, particularly in view of the fact that the shelf width varies from one refrigerated unit to the next. This problem is even further complicated by the fact that the width associated with each product channel will vary depending upon the particular size and shape of the product container to be merchandised therefrom, be it a twelve ounce, sixteen ounce, twenty ounce, one liter, two liter or three liter container.

The prior art shelving structures presently utilized for refrigerator cooler applications have generally taken on various physical forms and have been fabricated of many different types of materials. For the most part, many of such units presently used in this particular application have been of pre-determined dimensions and such units are not adjustable to accommodate either different spatial dimensions or different container sizes. Of those prior art units that are width adjustable, some such units include frangible side and/or rear portions which are easily broken off along weakened fracture lines formed in the shelving members during the manufacture thereof. Once such frangible portions are, in fact, broken off to adjust either the width or depth of the particular unit, such frangible portions are no longer usable and cannot be reattached to the main shelf portion for use in other applications. Still further, of those prior art units which are width adjustable and which include product trays or channels which are detachably connected laterally to each other in side-by-side relationship, all such units have suffered from certain disadvantages and short comings including poorly designed connection means which have lead to both strength and stability problems. It is therefore a principal aim of the present invention to obviate many of the disadvantages and shortcomings associated with the prior art devices and to provide a modular shelving system which will accommodate product containers of various sizes, which is width adjustable and compatible for use with all of the known refrigerated display coolers, and which includes improved means for interlocking any plurality of product modules so as to provide a unitary, stabilized structure.

SUMMARY OF THE INVENTION

The present product merchandising assemblies have overcome many of the disadvantages and shortcomings associated with known shelf display devices, and each teaches the construction and operation of an adjustable shelving assembly which is adaptable for use on and with existing shelving equipment, either on a flat shelf surface or on an inclined support structure for gravity feeding products therefrom. The present shelf assemblies can be used for both chilled and unchilled products and are particularly well suited for use in merchandising and displaying a wide variety of products therefrom such as soft drinks, juices, dairy products and so forth in supermarkets, convenience stores and the like, as well as use in a wide variety of other product merchandising and storage applications.

Each of the several embodiments of the present invention comprises a plurality of product modules which can be laterally interlocked together in side-by-side relationship to form an overall stabilized assembly for supporting products in a columnar array. Each product module preferably includes at least one product support channel for guiding products positioned therein, it being contemplated that the respective product channels may vary in lateral width not only to accommodate articles of different dimensions, but also due to the fact that some product modules may include more product channels as compared to others. This will be particularly true in certain applications as will be herein after explained. Importantly, each product module includes cooperatively engageable interlocking means associated with the respective side edge portions thereof in the form of a plurality of elongated keeper members and corresponding slots, each of such keeper members including improved means for providing a strong, tight and snug fit between the respective product modules when coupled together. The construction of the various product modules as well as the associated improved interlocking connection means enables any number of the present modules to be connected together in any preferred number to form a particular merchandising unit which not only conveniently fits in the allocated shelf space, but also includes the maximum number of product channels for the particular type of product containers to be merchandised therefrom. This is true whether the lateral width of each such product channel is the same or are of varying widths.

Each product module further preferably includes a plurality of parallel guide members extending between the front and rear wall portions thereof defining one or more parallel adjacent guide channels for guiding products positioned therein in parallel rows, although, depending upon the particular application, some embodiments of the present product modules may include no side wall or guide members or only one side wall or guide member as will be hereinafter further explained. Track members are preferably integrally formed with the floor portion within each guide channel and likewise extend between the front and rear wall portions of each product module thereby forming a support surface in each respective channel for supporting products positioned thereon. These track members form an open or lattice-type rail structure which facilitates the circulation of cool air around the products position thereon when the present modules are used in a refrigerated display cooler. Since that portion of the track members which lie adjacent to the front wall portion of each product module receives the most wear and tear during use, particularly, in a gravity-feed situation, an optional construction of the present track members includes making the individual rail members or runners forming the respective track members of an increased or thicker width near the front portion of each individual product module so as to reduce the wear and tear of such rail members in this area thereby extending the overall longevity of each product module.

Other optional features associated with the present product module includes means for adjusting the depth of each such product module to further facilitate accommodating such modules on existing shelves having varying depth. This adjustment means includes the use of frangible portions which extend adjacent the rear wall thereof, which frangible rear portions are easily broken off along weaken fracture lines formed in the product modules during the manufacture thereof. Still other optional features include the use of flexible or resilient guide wall means capable of providing lateral support for taller product containers positioned in the respective guide channels while at the same time providing smooth, free and unrestrictive movement of such products within such guide channels without binding, squeezing or otherwise hindering the product flow, particularly, in a gravity-feed situation. Drain means may also optionally be provided at the front portion of each guide channel so as to facilitate clean up of the unit if product spillage occurs.

Because of these capabilities, the present product modules provide simple and efficient means for effectively utilizing and maximizing available shelf space, particularly, when such modules are used in the wide variety of known refrigerator coolers presently utilized for merchandising a wide variety of soft drink products; they provide for the orderly and attractive arrangement and display of such products; they provide means for adjusting the overall width and/or depth of the subject units to accommodate varying sizes and different types of support structures; they provide effective means for enabling the circulation of refrigerated air around and between the rows of products positioned thereon when used in a refrigerated display cooler; and, because each of the present product modules are both detachable and reattachable to each other, such units provide an efficient and extremely stable modular assembly which maximizes adjacent positioning of a plurality of such units. Also, importantly, use of the present product modules are extremely cost effective because they are adaptable for use on and with existing shelving equipment; they require no additional parts, tools or other means for interconnecting the same; they can be utilized either on a flat shelf or on an inclined support structure for gravity feeding products therefrom; they obviate the need for utilizing a plurality of different merchandising units to both accommodate different styles of product containers and to achieve different product display widths; and, because of their versatility and ability to achieve any selected unit assembly width, they represent a one-inventory solution to a user enabling such user to organize and configure any particular shelf display to meet his/her specific needs and space requirements.

It is therefore a principal object of the present invention to provide an improved modular product merchandising assembly which affords maximum utilization of existing shelf space commonly found in supermarkets and other merchandising centers, including shelf space associated with refrigerated display coolers, wherein the overall width of such modular assembly is selectively adjustable to accommodate varying shelf widths.

Another object is to provide a plurality of product modules which include improved cooperatively engageable means for laterally attaching such modules in any preferred number to provide a strong, stable and unitary assembly.

Another object is to provide a modular product merchandising assembly which is universally adaptable for use with a wide variety of known product merchandising display equipment.

Another object is to provide a product merchandising assembly wherein the depth of each product module associated with such assembly is likewise adjustable to reduce the overall size thereof.

Another object is to teach the construction and use of several different types of product modules wherein the overall width of the respective product guide channels associated with such modules differ in their lateral dimensions for accommodating containers of different widths.

Another object is to provide a modular display assembly which maximizes adjacent positioning of a plurality of product modules.

Another object is to provide a modular display assembly wherein the product modules are reuseable over and over again thereby eliminating the need to discard unused product modules.

Another object is to provide a modular product merchandising assembly which is structurally and operationally simple and easy to install and configure into any selectable width without the use of tools or other means of assembling the same.

Another object is to provide a modular type display assembly which is relatively more stable, durable and able to withstand moderate impact without collapsing and disassembling.

Another object is to provide a modular product merchandising assembly which is adaptable for use both on and with existing shelving equipment, either on a flat shelf or on an inclined support structure for gravity feeding products therefrom.

These and other objects and advantages of the present invention will become apparent to those skilled in the art after considering the following detailed specification which discloses several representative embodiments of the present modular product merchandising assembly in conjunction with the accompanying drawings wherein:

Figure 1:
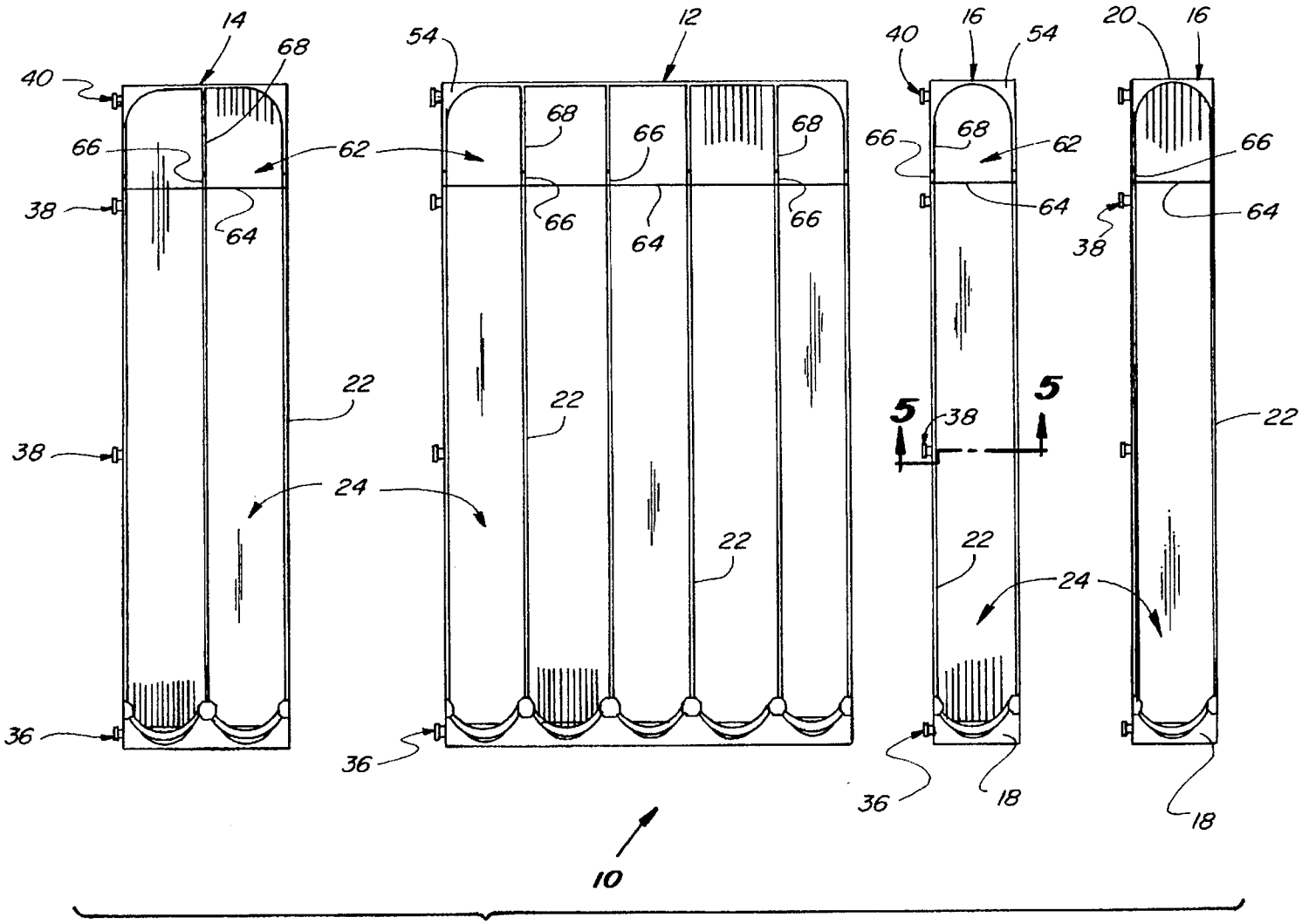
FIG. 1 is a top plan form view of a plurality of product modules constructed according to the teachings of the present invention.
Figure 5:
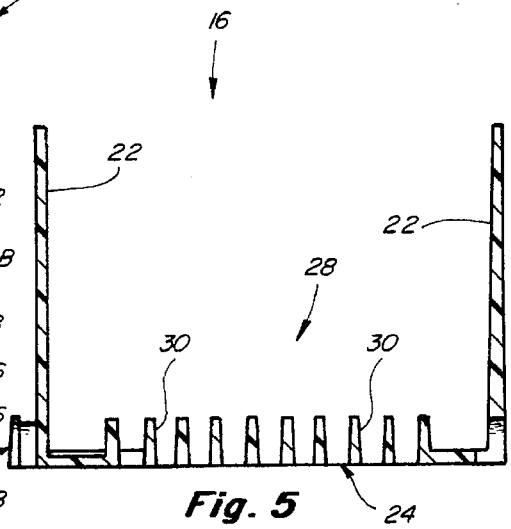
FIG. 5 is a cross-sectional view of one of the present product modules taken along line 5—5 in FIG. 1.
Figure 7:
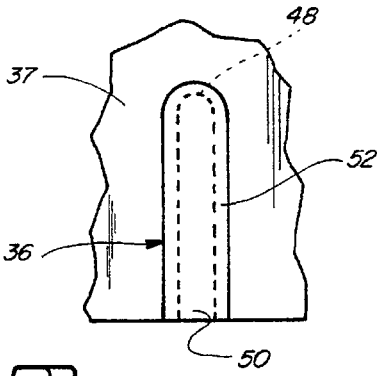
Figure 6:
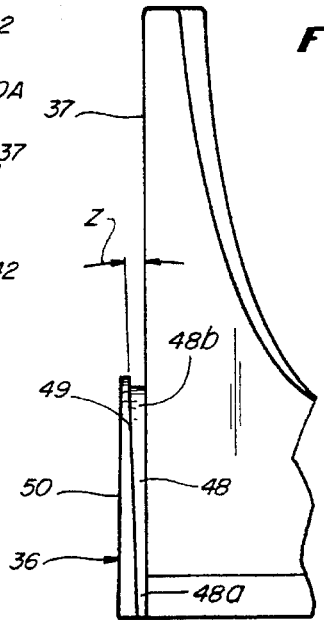
FIG. 6 is a fragmentary front elevational view of one corner of any one of the product modules illustrated in FIG.
Figure 8:
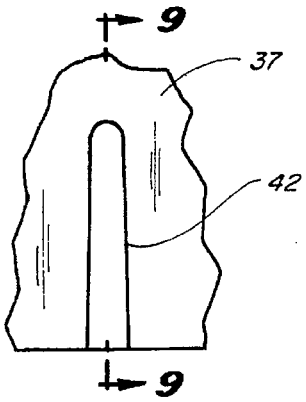
Figure 12:
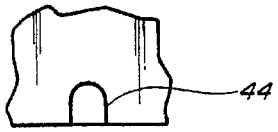
Figure 10:
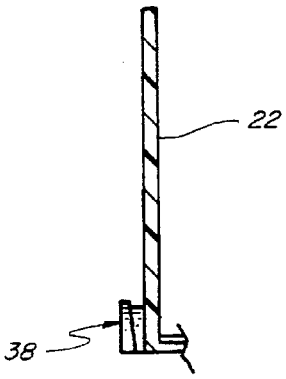
Figure 11:
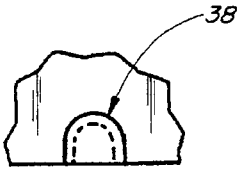
Figure 9:
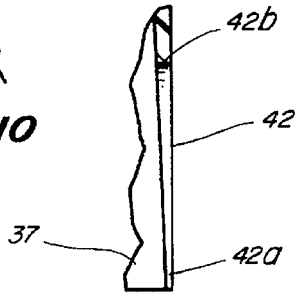
Figure 13:
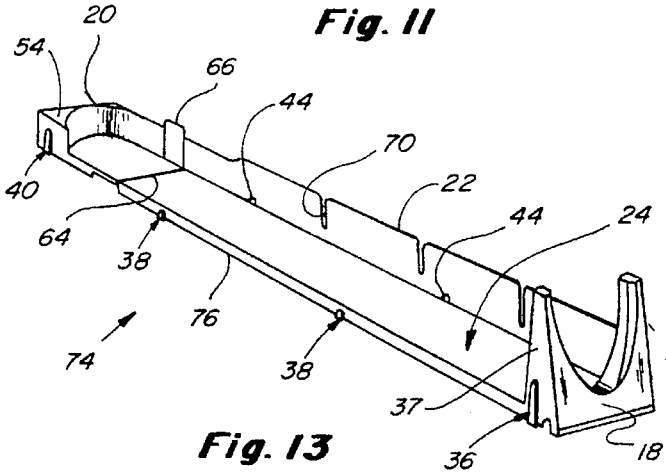
Figure 14:
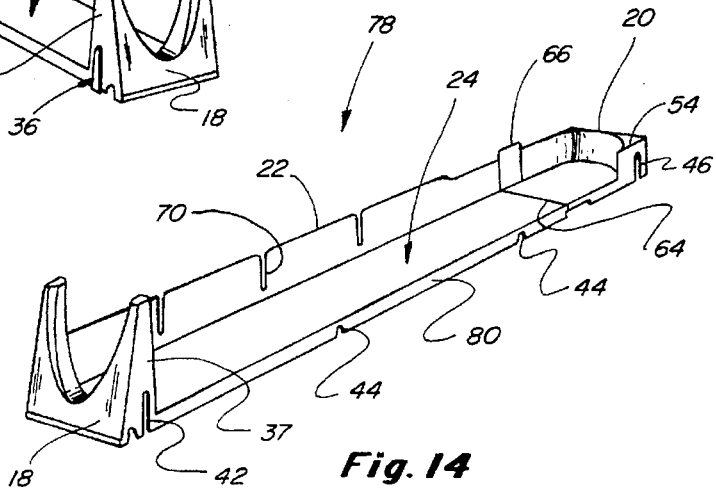
Figure 16:
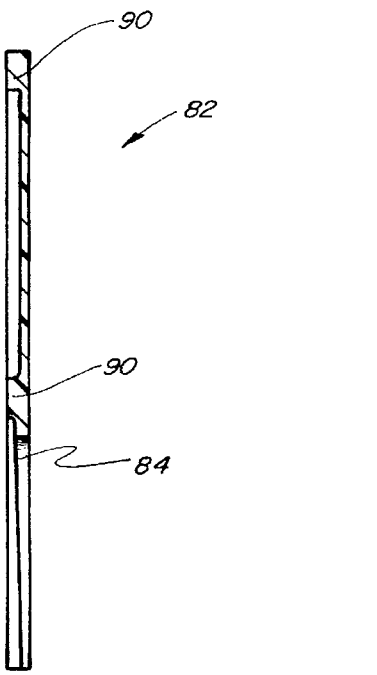
Figure 17:
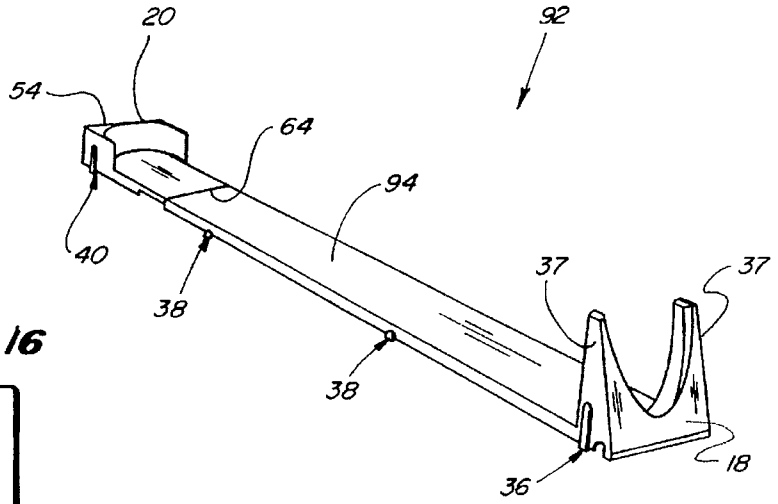
Figure 15:
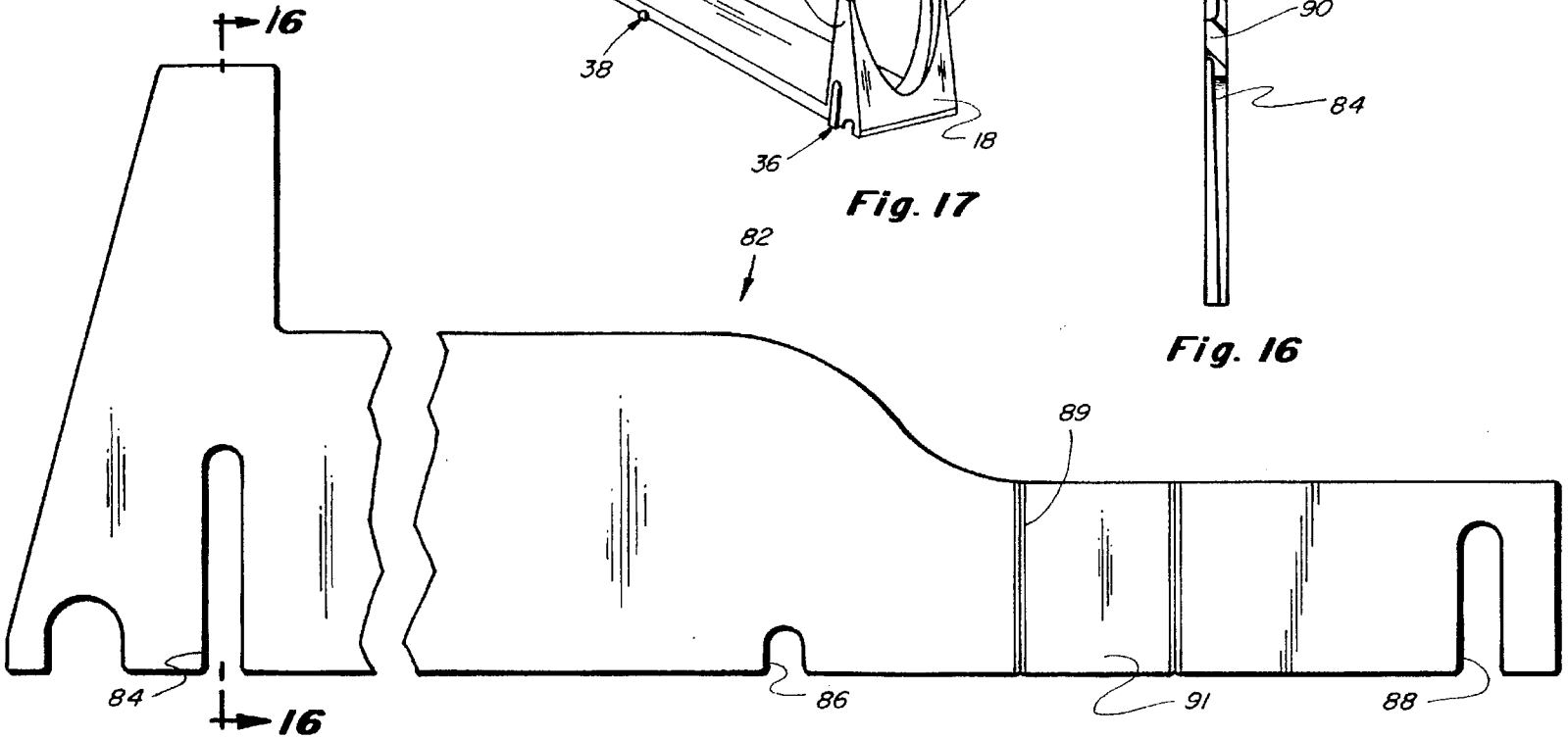

1 showing the front friction keeper member associated with the present invention;

FIG. 7 is a fragmentary side elevational view of the front friction keeper member of FIG. 6;

FIG. 8 is a fragmentary side elevational view of the front portion of any one of the product modules illustrated in FIG. 1 showing the corresponding keying slot for engaging the front keeper member illustrated in FIGS. 6 and 7;

FIG. 9 is a partial cross-sectional view of the front keying slot taken along line 9—9 of FIG. 8;

FIG. 10 is a fragmentary corner view of FIG. 5 showing the construction of one of the intermediate friction keeper members associated with the various embodiments of the present product modules;

FIG. 11 is a fragmentary side elevational view of the intermediate friction keeper member of FIGS. 5 and 10;

FIG. 12 is a fragmentary side elevational view of any one of the product modules illustrated in FIG. 1 showing the corresponding keying slot for engaging the intermediate keeper member illustrated in FIGS. 10 and 11;

FIGS. 13, 14, and 17 are perspective views illustrating other embodiments of the product modules of the present invention;

FIG. 15 is a broken side elevational view of a guide wall member which is attachable to the side edge portion of certain embodiments of the present product modules; and FIG. 16 is a cross-sectional view taken along line 16—16 of FIG. 15.

DETAILED DESCRIPTION OF THE PREFERRED EMBODIMENTS OF THE INVENTION

Referring to the drawings more particularly by reference numbers wherein like numerals refer to like parts, number 10 in FIG. 1 identifies one particular plurality of product modules constructed according to the teachings of the present invention, this particular plurality of product modules including a module 12 having five product channels associated therewith, a module 14 having two product channels associated therewith, and two separate product modules 16 each having a single product channel associated therewith. Since each product module 12, 14 and 16 is substantially similar in construction except for the number of product support channels associated therewith, and since the improved interlocking means associated with each of the present product modules is identical in construction, discussion of the present invention will be directed primarily to product module 16 as shown in FIGS. 1 and 3–5.

Figure 2:
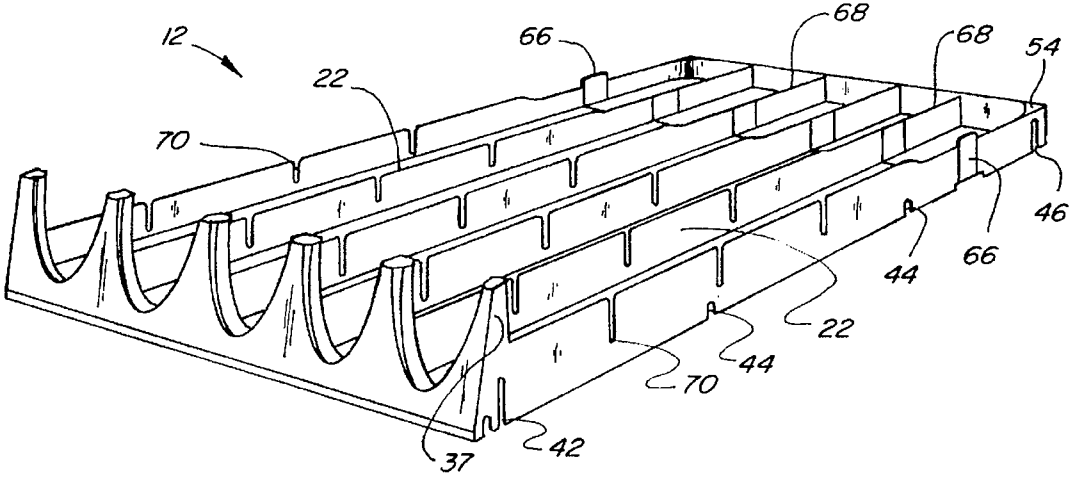
FIG. 2 is a perspective view of one of the product modules illustrated in FIG. 1, such product module having five product channels associated therewith.
Figure 3:
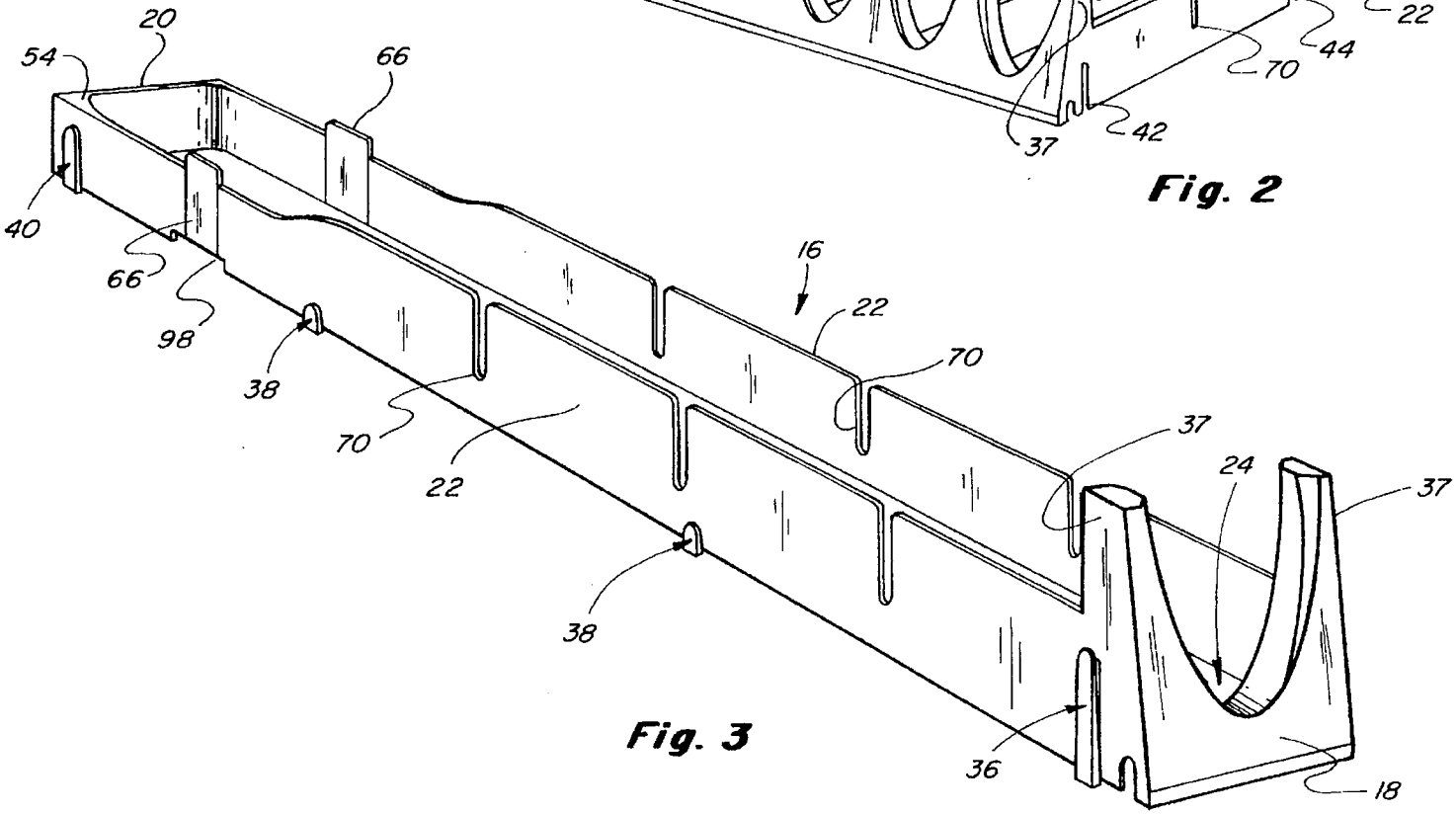
FIG. 3 is a perspective view showing the single channel product module illustrated in FIG. 1.
Figure 4:
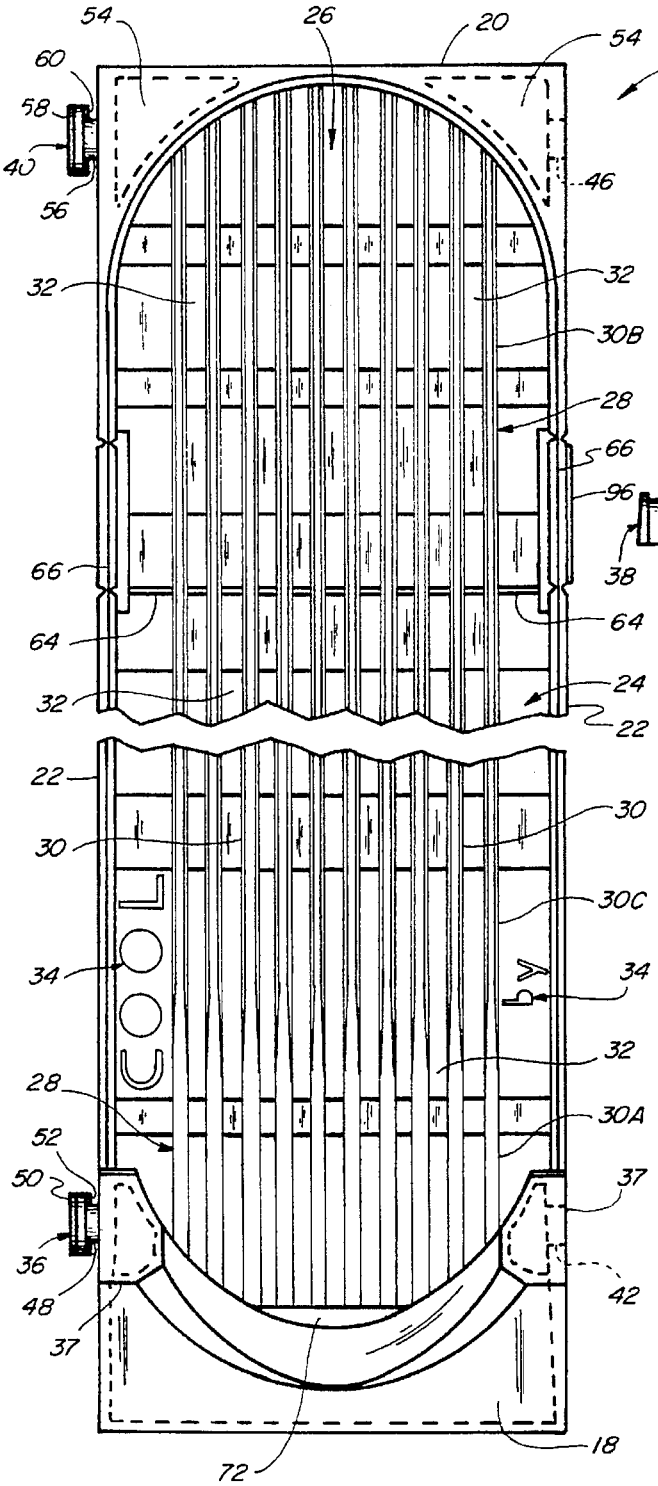
FIG. 4 is a broken top plan form view of the product module illustrated in FIG. 3.

Referring primarily to FIGS. 3–5, the product module 16 includes spaced front and rear wall portions 18 and 20, spaced upstanding guide members or side wall portions 22, and a floor portion 24 as best shown in FIG. 4 which extends substantially the full length and width of the module 16 between the front, rear and side wall portions thereof as shown in FIGS. 1 and 4. The upstanding guide members or wall portions 22 extend substantially between the front and rear walls 18 and 20 and defined therebetween a guide channel 26 for supporting and guiding products positioned therein. In the product module 12 illustrated in FIGS. 1 and 2, each guide channel 26 is also defined by the floor portion 24 located between adjacent guide members 22. The guide members 22 are preferably integrally formed with the modules 12, 14 and 16 for ease of manufacture and to lend strength and stability to each product module, although other suitable means may be used to attach the guide members 22 to the module floor structure 24. The floor portion 24 includes track means 28 (FIG. 4) which comprise a plurality of spaced longitudinally extending ribs, rails or runners 30 which project upwardly therefrom as best shown in FIG. 5. The upstanding ribs or runners 30 form the respective support surface in each respective channel 26 upon which products will be positioned for movement therealong. The rails or runners 30 are preferably integrally formed with the module structure such as through an injection molding process or other means for accomplishing the same. Because of the materials and lubricants used in the construction of the rail means 30, the rails or runners 30 reduce the friction between such surfaces and the products positioned thereon thereby improving the slideability of such products as they move across such runners from the rear of each module to the front portion thereof. This is particularly important when the present modules are used in a gravity-feed arrangement since products positioned thereon must be able to slide under the force of gravity towards the front portion of each module when the forward most products are removed therefrom. The actual construction of the track runners 30 as well as the materials and lubricants used to improve the slidability of products positioned thereon are more fully disclosed and described in U.S. Pat. Nos. 4,801,025; 4,454,949; and 4,416,380, all of which were issued to the present assignee. It is recognized that the construction of the guide channels 26, the track means 28, and the individual track runners 30 associated with the product modules 12 and 14 are substantially identical to those described with respect to module 16 except that modules 12 and 14 include a plurality of parallel adjacent guide channels 26 as best shown in FIG. 1.

It is also important to recognize that the spacing between the runners 30 should be such to accommodate any and all of the various products that are to be positioned thereon regardless of the shape or contour of their bottom walls. Since many articles of merchandise are packaged in containers having unique and unusual shapes, it is usually preferred to have the spacing between the runners 30 substantially uniform and relatively small across the width of each product channel 26 so as to accommodate and support products having many different bottom wall configurations. The specific spacing selected may be especially important for some products that have contoured bottom wall portions to properly support such products on the runners 30 to reduce the possibility that they will overturn. In this regard, each product channel 26 may include any plurality of rails or runners 30 depending upon the spacing between each pair of runners 30 so selected. Although not required, the impregnation of silicon or other lubricants into the plastic materials used to fabricate the runners 30 as described in the above-referenced U.S. patents substantially reduces the possibility that products stored thereon will jam or stick and not slide and it greatly enhances the reliability and effectiveness of the present product modules when they are employed in a gravity-feed system.

Still further, although not required, the individual rails or runners 30 may be fabricated so as to form an open or lattice-type rail structure as best shown in FIG. 4, the lattice-type rail structure including a plurality of openings 32 positioned within each respective guide channel 26 and between the respective rail members 30 so as to facilitate the circulation of cool air around the products positioned thereon when the present product modules are installed in a refrigerated display case. In this regard, those portions of the floor 24 which lie in longitudinal alignment on each opposite side of the outermost rail members 30 positioned adjacent opposed guide members 22 may likewise include openings or apertures to further facilitate the circulation of cool air through the floor portion 24 and around the products positioned on the track means 28. These additional apertures or openings may take the form of stamping out or molding manufacturer identification, product identification, trademarks or other indicia adjacent the upstanding guide members or partitions 22 such as the indicia 34 illustrated in FIG. 4. The openings through the various letters forming the indicia 34 further allow cool air to pass therethrough. It is recognized that the particular shape and number of the openings or indicia 32 and 34 can be varied considerably without departing from the teachings and practices of the present invention. Also, the greater the number and size of the openings 32 and 34, the better will be the air circulating characteristics of each individual product module. This additional feature makes the present product modules particularly advantageous for use in refrigerated display coolers and other types of cold vaults commonly found in supermarkets, convenience stores, grocery outlets, fast food outlets and a wide variety of other wholesale and retail stores. This enables the present product modules to be effectively utilized in such refrigerated display coolers as well as in other environments thus further increasing their usefulness.

Each product module 12, 14 and 16 includes cooperatively engageable interlocking connection means associated with the respective outer side edge portions of each such product module in the form of a plurality of friction grip keepers 36, 38 and 40 as well as a plurality of corresponding slots 42, 44 and 46 as best shown in FIGS. 1–12. The keepers 36 and 40 are elongated in shape as best shown in FIGS. 3 and 6 and are positioned respectively adjacent the outer surfaces of the front and rear portions of each product module. The front keeper or projection 36 is higher or longer as compared to the rear keeper 40 and is specifically located on the extended front wall leg portion 37 as best shown in FIGS. 2 and 3. The elongated keeper 36 takes advantage of the height of the front wall leg portion 37 and extends upwardly therealong as illustrated. As will be hereinafter explained, it is the height of the front and rear keeper members 36 and 40 which provide most of the locking capability and stability associated with the present connection means. The higher or longer the keeper members 36 and 40 are made, the better the security and stability of the connection when adjacent modules are coupled together, although, for certain applications, sufficient stability can also be achieved by using an elongated front keeper member only.

The front keeper member 36 comprises a somewhat modified T-shaped projection which includes a base or stem portion 48 and an overhanging flange portion 50 as best shown in FIGS. 4 and 6. Importantly, the base or stem portion 48 is outwardly tapered along its entire length from the bottom of the front wall portion towards its terminal end portion such that the lower portion 48*a* thereof is thinner than its respective top portion 48*b* as best shown in FIG. 6. In other words, the outer lateral mating surface 49 between the keeper portions 48 and 50 forms an angle Z with the vertically oriented side portion of the front wall associated with each product module. The keeper flange portion 50 overhangs the keeper portion 48 as best shown in FIG. 4, the overhanging portion forming a somewhat U-shaped lip portion 52 which surrounds the base or stem portion 48 on all sides thereof as best shown in FIGS. 4 and 7. The lip portion 52 forms a somewhat annular slot between the front wall leg portion 37 and such lip portion 52 which is compatible for receiving the corresponding slot 42 associated with an adjacent module. When two adjacent modules are coupled together as will be hereinafter explained, lip portion 52 will abut the inner side wall portion of an adjacent product module adjacent the corresponding slot means 42 so as to prevent the keeper means 36 from becoming disengaged therewith.

Also, importantly, the thickness of the wall portion forming the slot 42 is likewise tapered as shown in FIG. 9 such that the thickness of the wall portion forming such slot 42 is likewise thinner at its bottom portion 42*a* as compared at its top portion 42*b*. This means that as the slot 42 is engaged with the elongated keeper base portion 48 and is moved progressively downwardly towards the floor portion of the product module, the taper associated with stem portion 48 as well as the varying thickness of the side wall forming slot 42 will enable slot 42 to become progressively tighter as it is moved downwardly therealong. This double taper effect ensures a tight, strong, snug and stable connection between the keeper 36 and its corresponding slot 42 when adjacent product modules are coupled together. When coupled, the overlapping lip portion 52 likewise ensures that two adjacent product modules will not become disengaged from each other by exerting a sideward pulling force thereagainst. Disengagement can only be accomplished by slideably moving one coupled product module vertically relative to the other.

The rear keeper 40 is positioned adjacent the rear wall or edge portion of each product module and is specifically located on the outer wall surface of one of the molded rear corner or pocket portions 54 as best shown in FIG. 4. Similarly, the corresponding slot 46 for engagement with the keeper member 40 is likewise positioned on the outer face of the opposite rear corner or pocket portion 54 as likewise illustrated in FIG. 4. The corner or pocket portions 54 are specifically located so as not to interfere with products positioned within the corresponding product channels 26 and do not form part of the upstanding guide walls or partitions 22 which are specifically designed for guiding and containing products within each respective product channel as such products move from the rear of each product channel towards the front portion thereof. The interlocking keeper 40 is identical in construction to the interlocking keeper 36 in all respects except that the keeper member 40 is not as tall or as high as the member 36. This is due to the fact that the height of the rear corner or pocket portion 54 is not as tall as the front wall leg portion 37 forming the respective sides of the inverted arch front wall design associated with the front portion of each product module illustrated herein. This is best illustrated in FIG. 3 wherein both the front and rear keeper members 36 and 40 associated with one side portion of any one of the present product modules can be viewed relative to each other. Like the keeper member 36, the base or stem portion 56 of keeper member 40 is likewise tapered outwardly similar to the base or stem portion 48 illustrated in FIG. 6. Similarly, the flange portion 58 of keeper member 40 is likewise constructed substantially identical to the flange portion 50 associated with keeper member 36 as illustrated in FIG. 6 and likewise includes an overhanging lip portion 60 which is similar to the lip portion 52 illustrated in FIG. 7. Engagement of keeper member 40 with its corresponding slot 46 is identical in all respects with the engagement of keeper member 36 with its corresponding slot 42 as previously explained. In this regard, the construction of the side wall portion forming slot 46 is likewise tapered similar to the construction of slot 42 illustrated in FIG. 9 in that the upper portion of slot 46 is thicker than the lower portion thereof. The only difference between slot 42 and slot 46 is the relative height therebetween as best illustrated in FIG. 2.

Each of the present product modules also includes friction keeper members 38 which are positioned and located at spaced apart locations intermediate the front and rear wall portions of each product module on the same outer side edge portions thereof as keeper members 36 and 40 as best shown in FIG. 3. Depending upon the length of each product module, any number of intermediate keeper members 38 may be located between the front and rear keeper members 36 and 40 as illustrated. Importantly, keeper members 38 are preferably integrally formed adjacent the bottom edge portion of the product module and, more particularly, adjacent the respective floor portion thereof as is more apparent in alternative embodiments of the present product modules illustrated in FIGS. 13, 14 and 17. Again, the construction and operation of the friction keeper members 38 is substantially identical to keeper members 36 and 40 and the keepers 38 differ therefrom only in their overall height. The same is likewise true with respect to the corresponding slots 44 positioned in corresponding relationship on the opposed outer side edge portion of each product module. Here again, it is important that the overall height of the slots 44 do not extend much beyond the upper surface portion of the track runners 30 located within each product channel 36 so that engagement of the keeper members 38 with their respective corresponding slots 44 will not protrude above the track means 28 so as to interfere with movement of products positioned thereon. Although it is possible to construct both the keepers 38 and their corresponding slots 44 such that they extend above the height of the individual runners 30 and extend upwardly into a portion of the respective guide wall member 22 in order to obtain a more secure interlocking engagement respectively therewith, this is neither preferred nor necessary since the present construction provides more than enough stability and extending the members 38 and slots 44 further upwardly unto the guide member 22 does present product interference problems as explained above.

Since the relative height of the slots 44 are considerably shorter than slots 42 and 46, the taper associated with the side walls forming the slots 42 and 46 is not critical with respect to slots 44. This is due to the relative shortness associated with the overlapping engagement between the slots 44 and the keeper members 38. This means that, for ease of manufacture, the side wall thickness associated with the slot 44 can be made uniform in cross-section throughout its entire expanse. The height of the keeper member 38 relative to the track runners 30 is best illustrated in FIG. 5.

It is important to note that it is the front and rear connection means associated with each product module, namely, the intercoupling engagement of the friction keeper members 36 and 40 with their corresponding keying slots 42 and 46, which provide most of the frictional engagement between two adjacent coupled product modules. Although the intermediate keeper members 38 likewise provide engagement capabilities when coupled with the slots 44 associated with an adjacent product module, the intermediate keeper members 38 serve more to stabilize the center portion of two adjacent units when coupled together and provide additional strength and stability to a composite assembly. Since the overall height of the intermediate keeper members 38 and corresponding slots 44 are somewhat restricted due to the overall height of the rail members 30 forming the track means 28, it is important that the front and rear keeper members 36 and 40 be sufficiently long so as to ensure a strong, tight and snug fit therebetween when two adjacent product modules are joined together in accordance with the present invention. As previously explained, it is therefore important to take advantage of the height associated with the upstanding front wall leg portions 37 as well as the rear corner or pocket portions 54 so as to make the keeper members 36 and 40 as well as their corresponding slots 42 and 46 of sufficient height to ensure a strong, tight joinder therebetween. This is clearly illustrated in FIGS. 2, 3, 13, 14 and 17. The taper associated with each of the respective keeper members 36, 38 and 40 as well as the taper associated with the side wall construction of slots 42 and 46 provide improved means for laterally interlocking adjacent product modules in a side-by-side relationship to form an overall more stabilized assembly for supporting products in a columnar array so as to achieve any desired width and any desired number of product channels depending upon a particular merchandising application. The composite shelf assembly achieved through the use of the present improved interlocking connection means as explained above is more rigid and stable as compared to prior art assemblies and is ideally suited for use with existing shelving equipment, either on a flat shelf surface or on an inclined support structure for gravity feeding products therefrom.

Although generally not preferred in certain applications, sufficient locking capability and stability may be achieved through the use of only one sufficiently long front keeper member. This means that the rear keeper member may be fashioned similar in size to the intermediate keeper members 38 as to provide sufficient joinder and stability to the rear portions of two coupled modules. In this situation, it is generally preferred that the front keeper member be made of sufficient height to ensure a strong, snug fit between adjacent units since the side or leg portions of most front walls associated with the known product merchandising units are of sufficient height to accommodate this need. For certain applications, this combination of keeper members provides adequate support.

Since that portion of the individual track runners 30 which lie adjacent to the front wall portion of each product module normally receives the most wear and tear during use, particularly, in a gravity-feed situation wherein product containers are always located adjacent the front wall of each product module, the individual rail or track runners 30 may be optionally constructed so as to include an increased or thicker rail width near the front portion of each product channel so as to reduce the wear and tear of such rail members in this high use area thereby extending the overall longevity of each product module. As best illustrated in FIG. 4, the overall width of each track runner 30 varies from front to rear, each runner 30 including a wider or thicker rail portion 30A adjacent the front wall portion of each product channel 26, a narrower runner portion 30B adjacent the intermediate and rear portions of each product channel 26, and a transition rail portion 30C therebetween. Depending upon the size and weight of the product containers positioned on the rail members 30, the transition region 30C may be adjusted fore and aft depending upon the particular products dispensed therefrom as well as the particular display application involved. For ease of manufacture and construction, the width of the individual track runners 30A is substantially constant from the front wall portion of each product channel 26 up to the transition region 30C and the width of the track runners 30B is likewise substantially constant from the transition region 30C to the rear end portion of each channel 26, such width varying only in transition region 30C.

Each product module 12, 14 and 16 may likewise optionally include a frangible rear portion 62 which is defined by the weakened fracture line 64 as best illustrated in FIGS. 1 and 4. The fracture line 64 extends substantially between the opposite side walls associated with each product module at an intermediate location spaced between the front and rear wall portions respectively thereof as shown in FIGS. 1 and 4. The fracture line 64 includes a thin-walled section of reduced cross-sectional area which can be easily fractured and removed through use of a bending motion. A plurality of removable tabs 66 are generally positioned along the weakened fracture line 64 defining each respective rear frangible portion 62 as best shown in FIGS. 1, 2 and 4, the tabs 66 lying in direct alignment with each respective guide member 22 and connecting such guide members 22 with corresponding channel divider members 68 which form continuations thereof. The tabs 66 interconnect the guide members 22 with the channel divider wall portions 68 associated with the rear frangible portion to add strength and stability thereto. The details associated with the construction of the rear frangible portions 62 as well as the tab members 66 are set forth and disclosed in U.S. Pat. No. 4,801,025 which issued to the present assignee. The tab members 66 can be easily snapped and broken off and once these tabs are broken, the frangible rear portions 62 may be easily detachably removed by pressing downwardly on the rear portions thereof to snap off and sever such rear portions from the remainder of the various product modules. This enables a user to easily adjust the overall depth of each product module. This optional capability allows each of the present product modules 12, 14 and 16 to be length or depth adjustable thereby further increasing the usefulness and marketability of the present modules.

Each of the parallel guide wall members 22 associated with the present product modules 12, 14 and 16 may likewise be constructed optionally so as to be taller in overall height as well as flexible and/or resilient. In addition, each of the present guide members 22 may also include one or more slots or notches 70 as best shown in FIGS. 2 and 3 located at spaced locations along at least a portion of the length of each guide member 22, each slot or notch 70 extending in a vertical orientation as shown in FIGS. 2 and 3. The taller resilient product guide members 22 provide lateral support for taller products positioned in the respective product channels 26 so as to prevent such taller products from tipping or toppling over the respective divider walls into adjacent products or channels as such products are removed therefrom. Also, importantly, the guide members 22 serve to guide and direct any movement of the products along the respective channels 26, as the flexibility of the present members 22 enables smooth, free and unrestricted movement of the products within the channels 26 without binding, squeezing or otherwise hindering the product flow, particularly in a gravity-feed situation. The slots 70 improve the flexibility of each respective guide member 22 and allow such guide members to closely follow the shape of the respective guide members in the event that the product module or composite shelf assembly sags or twists for any reason such as when heavily loaded or inadequately supported. This is true because the plurality of slots 70 associated with each of the present guide members 22 segregates the present guide members into a plurality of shorter segmented portions each capable of flexing due to the thinness and resiliency of each member. The present slots 70 ensure free movement of products along each respective product channel 26 without being pinched, squeezed or otherwise engaged or restrained by the present guide members 22 even when the present product modules are fully loaded, or unevenly loaded. The constructional details associated with the taller flexible slotted guide members 22 as well as variations thereof are fully explained and disclosed in Applicant's co-pending U.S. patent application Ser. No. 08/087,670 filed Jul. 7, 1993, which application is likewise assigned to the present assignee.

Still further, each of the present product modules may include optional drain means associated with each product channel 26. As best illustrated in FIG. 4, the present drain means includes an opening or space 72 formed adjacent the front wall portion of each product channel 26. The opening 72 provides a means for any product spillage which may occur within each product channel 26 to easily escape and drain from the front track portion thereof thereby facilitating cleanup. This is particularly true if the floor portion and track portion of each respective product channel includes no openings 32 and/or 34 or other means for allowing air to circulate therethrough thereby allowing product spillage to accumulate on and between the respective track rails 30 in each respective product channel 26. This not only presents an unattractive appearance to consumers removing product containers from each product channel 26, but it also may hinder and impede the free movement of product containers along the top surface of each rail or runner 30, particularly in a gravity-feed situation, since the spillage of most liquid products, particularly soft drink products, will leave a sticky residue on the track rails 30 when dried. The drain means 72 allows a user to tilt the present product modules such that any spillage will travel forward to the front wall portion of each product channel 26 and exit through drain means 72.

The composite shelf assembly disclosed in FIG. 1, namely, the five wide track module 12, the two wide track module 14, and two individual one track wide modules 16, offers a one-inventory solution for most of the existing refrigerated display coolers presently utilized in the marketplace as well as other existing shelving equipment and this particular assortment of product modules having a different number of product channels associated therewith covers all of the possible shelf width applications for twelve ounce, sixteen ounce and twenty ounce single serve soft drink containers ranging from a one track wide module to a nine track wide module. Typically, a five track wide unit is the minimum required in the industry and such a unit will fit in all of the presently utilized conventional refrigerated display coolers. The present product module 12 satisfies this need. Since the width associated with the known refrigerated display coolers and other conventional shelving equipment vary in width, the present modules 12, 14 and 16 can be interconnected with each other, either alone or in various combinations, in order to provide a unitary composite assembly having any number of product channels associated therewith ranging from one single product channel (module 16) to nine product channels including any number of product channels therebetween. The present modular arrangement therefore accommodates any particular merchandising application and the present modules can be assembled in columnar array to achieve any desired width and any desired number of product channels as explained above. This is particularly advantageous to a merchant who typically utilizes many different types of display shelving in his/her place of business in order to display a wide variety of products to consumers. Use of the present modular system enables such merchant to combine and assemble the present modules 12, 14 and/or 16 so as to achieve any selected unit assembly width depending upon the particular merchandising shelf space available. This represents a one-inventory solution to a user since he/she does not have to buy and stock a wide variety of different types of display equipment in order to meet his varying needs. Use of the present product modules therefore provide the much needed flexibility and versatility enabling users to build any size merchandise display in any type of store environment from convenience store displays to large refrigerated displays commonly used in supermarkets and hypermarkets while at the same time being extremely cost-effective.

It is also recognized and anticipated that the width of each product channel 26 may be varied to accommodate different size product containers such as one liter, two liter and three liter soft drink containers presently utilized in the soft drink industry. It is also recognized that the width of the product channels 26 may vary within the same product module. For example, the width associated with some or all of the five product channels 26 illustrated in module 12 may be different from each other such that some product channels are capable of merchandising smaller product containers therefrom while other product channels in the same product module are capable of merchandising larger product containers therefrom. In this regard, it has been found that as the width of the individual product channels 26 are enlarged from a width suitable to accommodate a twelve or sixteen ounce single serve soft drink container to a width suitable to accommodate a one or two liter soft drink product container, it is no longer possible to achieve the maximum number of product channels in a particular space in certain applications. For example, if the product channels 26 associated with product modules 12, 14 and 16 are expanded to accommodate a one liter soft drink container, use of the present product module construction may not allow a user to fit eight product channels in certain display applications. Instead, the space available in some of the known refrigerated display coolers will only allow a maximum of seven product channels to accommodate such space with the end result that some shelf space will remain unused adjacent such a modular arrangement. In order to alleviate this situation and again maximize the available shelf space in conventional display coolers and other known shelving equipment, it has been found that sufficient additional space can be regained in a modular assembly by eliminating one of the outermost guide wall members associated with each product module. As a result, alternative embodiments of the present product modules are illustrated in FIGS. 13 and 14.

Referring to FIG. 13, the product module 74 illustrated therein is substantially similar in construction and operation to the product modules 12, 14 and 16 but differs therefrom only in that one of the outer guide wall members 22 has been removed. Also, the floor portion 24 of product module 74 is shown as a smooth planar surface for illustrative purposes only and does not include the track or rib members 30 illustrated in FIG. 4. It is recognized that the same or different track arrangement illustrated with respect to product modules 12, 14 and 16 can likewise be utilized with product module 74 or any other module constructed according to the teachings of the present invention. The construction and operation of the friction keepers 36, 38 and 40 as well as the corresponding keying slots 42, 44 and 46 (not shown in FIG. 13) associated with module 74 are identical to that disclosed with respect to product modules 12, 14 and 16. In this regard, it is important to note that, in embodiment 74, the interlocking keeper member 36, 38 and 40 are positioned and located on the side of the product module which does not include a guide member 22, the elongated keeper member 36 being positioned adjacent the outer surface of the front wall leg portion 37 whereas the rear keeper member 40 is positioned adjacent the outer wall surface associated with one of the molded corner or pocket portions 54 as previously explained. It is also important to recognize that the outer wall surface of the corner or pocket portion 54 as well as the outer wall surface associated with the front leg portion 37 do not form any portion of the side guide wall member 22. This is likewise true with respect to the construction of product modules 12, 14 and 16. Also, importantly, as is clearly shown in FIG. 13, the intermediate friction keeper members 38 are positioned and located at spaced apart locations on the outer side edge 76 of the floor portion 24 as illustrated. This is identical to the construction of the keeper members 38 with respect to product modules 12, 14 and 16. Although not shown in FIG. 13, the corresponding keying slots 42, 44 and 46 are positioned and located in corresponding positions adjacent the outer surface of the opposed outside edge portion of the product module 74 incorporating the guide wall member 22 similar to the construction of the slots 42, 44 and 46 illustrated in FIG. 2 with respect to product module 12.

The product module 78 illustrated in FIG. 14 is substantially similar in construction and operation to the product module 74 illustrated in FIG. 13 but differs therefrom only in that the corresponding keying slots 42, 44 and 46 are positioned and located on the outer side edge 80 of the floor portion 24 adjacent the side edge portion of the module 78 which does not include a guide wall member 22. In this particular embodiment, the interlocking keeper members 36, 38 and 40 are positioned and located on the outer surface of the opposed side edge portion of the module 78 which includes the guide wall member 22 substantially identical to the arrangement of the keeper members associated with product module 16 illustrated in FIG. 3. In all other respects, the product module 78 operates and functions similar to product module 74.

It is also recognized and anticipated that the product modules 74 and 78 can be constructed to include any number of product channels 26 similar to product modules 12 and 14 and that such modules can be interconnected together to form a unitary composite assembly of any selectable width. Similarly, it is recognized that an entire modular assembly can be comprised using only product modules patterned after the construction of product module 74, or an entire modular assembly can be comprised using product modules patterned after the construction of product module 78. In either case, since modules 74 and 78 are L-shaped in overall configuration, one side edge portion of a composite modular assembly utilizing such modules will not include a guide wall member to close off the last product channel on that particular side. In order to remedy this situation, FIGS. 15 and 16 illustrate one embodiment of a separate, individual guide wall member 82 which would be attachable to the side edge portion of either module 74 or 78. In the particular embodiment illustrated in FIGS. 15 and 16, the guide wall member 82 includes a plurality of keying slots 84, 86 and 88 similar to the slots 42, 44 and 46 illustrated in FIGS. 1, 2, 8 and 12. The slots 84, 86 and 88 are specifically positioned and located on the guide wall member 82 so as to cooperatively engage the friction keeper members 36, 38 and 40 associated with product module 74. The guide wall member 82 is shaped and dimensioned so as to correspond to the outer guide wall member 22 associated with module 74 and is attached thereto by merely aligning the keeper member 36, 38 and 40 with the corresponding slots 84, 86 and 88 and merely exerting a downward force on the guide wall member 82 so as to engage its keying slots with the respective friction keeper members associated with the module 74. Use of the member 82 as explained above will provide a guide wall member adjacent the side edge portion of any such composite array of modules which did not initially include a guide wall member. In this regard, it is recognized and anticipated that, instead of the slots 84, 86 and 88, the guide wall member 82 may likewise include a plurality of friction keeper members similar to the keeper members 36, 38 and 40, such keeper members being positioned and arranged along the length of the guide wall member 82 so as to be cooperatively engageable with the plurality of slots 42, 44 and 46 associated with the open side portion of product module 78. In other words, the guide wall member 82 may be constructed with the appropriate coupling means necessary for cooperatively engaging the corresponding coupling means associated with the open side portion of the particular module to which it will be attached, whether such coupling means includes a plurality of keying slots or a plurality of friction keeper members as described in detail above. Also, the specific construction and configuration of the slots and/or keeper members associated with the guide wall member 82 may take on any one of the various configurations discussed above including the taper associated respectively with the front and rear keeper members as well as the taper associated with their corresponding keying slots.

Since the guide wall member 82 is a stand alone member, it may include additional reinforcing structure, particularly in the front portion thereof, such as the reinforcing rib members 90 illustrated in FIG. 16. Also, it should be noted that FIG. 16 also illustrates the tapered wall portion associated with the front slot 84 similar to that illustrated in FIG. 9 with respect to slot 42. Although tapering the thickness of the wall portion forming the slots 84 and 88 is generally preferred to further improve the locking capability between the corresponding coupling keeper members and slots, such taper is not mandatory as explained above. Still further, the guide wall member 82 may likewise include a weakened fracture line 89 or a removable tab member 91 for severing the rear portion of the member 82 so as to be compatible with the frangible rear portions associated with the product modules 74 and/or 78.

It is also recognized that one of the product modules 12, 14 or 16 may likewise be utilized at one end portion of a composite assembly utilizing modules 74 and/or 78 in order to provide a guide wall member 22 adjacent the open side portion of any such composite array. In this regard, it is further recognized that product modules 12, 14, 16, 74 and 78 can be coupled together in any combination to provide an overall unitary composite assembly. For example, product module 74 can be interconnected to the right side of any of the product modules 12, 14 and 16 illustrated in FIG. 1 whereas product module 78 can be similarly interconnected to the left side of any of the product modules 12, 14 and 16. Other combinations are likewise possible.

Use of the L-shaped product modules such as the modules 74 and 78, particularly when each product channel 26 is sized to accommodate one liter soft drink product containers, will allow a user or merchant to position an eight wide track assembly in most conventional refrigerated display coolers. This again maximizes utilization of existing shelf space associated with known refrigerated display coolers and affords a user even more flexibility in that a merchant can selectively adjust the present modular assembly to accommodate any shelf width while still obtaining a strong, stable and unitary assembly for merchandising products therefrom. The various embodiments of the present invention therefore provide a modular assembly which is universally adaptable for use with a wide variety of known product merchandising display equipment including conventional refrigerated coolers and use of such product modules greatly increase the product capacity of such conventional devices.

It is also recognized that for certain merchandising applications, the use of side walls or guide members such as the members 22 and 82 illustrated in many of the various embodiments of the present product modules are not necessary in order to accomplish the particular merchandising display. This is true where the type of product or the particular product container or packaging does not require the use of segregated product channels in order to display and merchandise such products to the consuming public. In such a situation, any plurality of the product module 92 illustrated in FIG. 17 may be used. The product module 92 is likewise substantially similar in construction and operation to the product modules 74 and 78 but differs therefrom only in that it does not include any outer guide wall members such as the members 22 illustrated in FIGS. 13 and 14 adjacent each outer edge portion of the module. Instead, the module 92 includes a front wall portion 18, a rear wall portion 20, front wall side portions 37 and rear corner or pocket portions 54. In all other respects, the product module 92 is substantially similar to product modules 74 and 78 including the construction and operation of the friction keeper members 36, 38 and 40 as well as their corresponding keying slots 42, 44 and 46 (not shown in FIG. 17) which are positioned and located in opposed relationship on the respective outer side edges of the floor portion 94 as illustrated. For still other applications, it is also recognized that the rear wall 20 as well as the rear corner or pocket portions 54 may be eliminated and the keeper member 40 and its corresponding keying slot 46 may be replaced with another keeper member 38 and its corresponding keying slot 44. Like the product modules 12, 14, 16, 74 and 78, the product module 92 can be constructed of varying width and such modules can be interconnected together to form a unitary composite assembly of any selectable width depending upon the particular merchandising application. Also, importantly, it is similarly recognized that the product module 92 can be coupled together in any combination with product modules 12, 14, 16, 74 and 78 so as to provide a unitary composite assembly. Also, importantly, the separate guide wall member 82 can likewise be used in conjunction with product module 92 and the guide wall member 82 can be constructed so as to be cooperatively engageable with the present coupling means on one or both opposite side edge portions of the product module 92.

Each product module 12, 14, 16, 74, 78 and 92 may likewise optionally include a separate locking mechanism associated with each of the present modules for preventing inadvertent separation when two such modules are coupled together. This additional locking mechanism is best illustrated in FIGS. 3 and 4 and includes at least one outwardly or laterally extending flange or projection 96 (FIG. 4) associated with one side edge portion of any of the present modules and a corresponding recess or cavity 98 (FIG. 3) associated with the opposite side edge portion of such modules. The recess or cavity 98 is positioned in opposed relationship to its corresponding projection 96 and is dimensioned so as to receive the projection 96 when adjacent modules are coupled together. The projections 96 are designed to push against the outer guide wall member 22 associated with an adjacent module, if such module includes an outer guide wall member on that particular side edge portion, as the present coupling slots 42, 44 and 46 are moved progressively downwardly into engagement with the present keeper members 36, 38 and 40 such that when the present slots are fully engaged with their corresponding keeper members, the projection 96 will simultaneously engage the recess 98. When so engaged, the projection 96 will engage the perimeter of the recess 98 and prevent one module from inadvertently moving upwardly towards a disengaged position due to product weight or other factors. Although the present projection 96 is shown formed integral with one of the tab members 66, it is recognized and anticipated that the projection 96 can be located anywhere along the full length of the side edge portion of the particular module and such projection 96 can be formed integral with such side edge portion. The same is likewise true with respect to the corresponding recess 98. Also, importantly, although only one projection 96 and corresponding recess 98 are illustrated in FIGS. 3 and 4, it is further recognized that any number of such projections and corresponding recesses can be positioned and located along the full length of each respective side edge portion of any particular module so as to further ensure the prevention of inadvertent separation when two such modules are coupled together. Disengagement of two interlocked modules can be easily accomplished by merely exerting a slight sideward force between two adjacent modules so as to remove the projection 96 from within its corresponding recess 98 before exerting upward movement to disengage the present keying slots from their respective keeper members.

Also, importantly, all of the present product modules are reusable and can be easily attached and detached, at will, to adjacent modules to achieve any desired width and any desired number of product channels depending upon the particular merchandising application.

Thus, there has been shown and described several embodiments of a novel product modular assembly for use in storing and merchandising shelved products, including products requiring refrigeration, which devices are easily adaptable for use on existing shelving equipment and fulfill all of the objects and advantages sought therefor. Many changes, modifications, variations, and other uses and applications of the present constructions will, however, become apparent to those skilled in the art after considering this specification and the accompanying drawings. All such changes, modifications, variations and other uses and applications which do not depart from the spirit and scope of the invention are deemed to be covered by the invention which is limited only by the claims which follow.

What is claimed is:

1. A product support module adaptable for interlocking engagement with substantially similarly constructed modules to form a selectable width composite display assembly for merchandising products therefrom, said module comprising a floor member having front and rear wall portions and opposed side edge portions, said front wall portion having a side portion associated respectively with each opposite end thereof, said rear wall portion having a side portion associated respectively with each opposite end thereof, said rear wall side portions extending partially along each respective opposite side edge portion of said floor member, said module including cooperatively engageable means associated with the respective side edge portions thereof enabling said module to be coupled together with a substantially similarly constructed module, said cooperatively engageable means including a plurality of elongated friction keeper members associated with one of said side edge portions of said product module and a plurality of corresponding keying slots associated with the opposite side edge portion thereof, said plurality of keeper members including at least a front keeper member and a rear keeper member, said front keeper member being positioned and located on the outer surface of one of said front wall side portions and said rear keeper member being positioned and located on the outer surface of one of said rear wall side portions, the corresponding keying slots for engaging said front and rear keeper members being positioned in opposed relationship to said keeper members on the opposite front and rear wall side portions associated with the opposite side edge portion of said product module, said front keying slot being cut into said corresponding front wall side portion such that the thickness of the opposed wall portions forming said front keying slot is thinner at their respective lower portions as compared to their respective upper end portions, said plurality of keeper members each including a stem portion and an overhanging flange portion, the stem portion associated with said front keeper member being tapered in a direction which extends outwardly away from the front wall side portion of said product module along its entire length from its lower portion to its upper terminal end portion such that the mating surface between said stem portion and said overhanging flange portion forms an angle with the front wall side portion of said product module, the taper associated with said front keeper stem portion causing the thickness of said stem portion to be thinner at its lower portion as compared to its upper end portion, the taper associated with said front keeper stem portion in conjunction with the variation in thickness associated with the wall portions forming the front keying slot enabling said corresponding front keying slot to become progressively tighter thereby drawing adjacent units closer together as said slot is moved progressively downwardly over said front keeper stem portion.

2. The product support module defined in claim 1 including at least one intermediate keeper member and a corresponding keying slot positioned at respective intermediate locations between said front and rear keeper members and said front and rear keying slots, said at least one intermediate keeper member and its corresponding keying slot being located on the respective opposed outer side edge portions of said product module.

3. The product support module defined in claim 2 wherein said front and rear keeper members and their corresponding keying slots are taller in height than said at least one intermediate keeper member and its corresponding keying slot.

4. The product support module defined in claim 2 wherein said at least one intermediate keeper members includes a stem portion and an overhanging flange portion, the stem portion associated with said at least one intermediate keeper member being outwardly tapered along its entire length from its lower portion to its upper terminal end portion such that the mating surface between said stem portion and said overhanging flange portion forms an angle with the side edge portion of said product module.

5. The product support module defined in claim 1 wherein said product module includes a guide wall member extending between the front and rear wall side portions associated with one side edge portion thereof.

6. The product support module defined in claim 5 wherein the opposite side edge portion of said product module likewise includes a guide wall member extending between the front and rear wall side portions associated therewith.

7. The product support module defined in claim 1 including means extending transversely across said product support module between the opposed side edge portions thereof at an intermediate location between said front and rear wall portions for weakening said product module whereby said module can be separated along said weakening means into separate front and rear portions.

8. The product support module defined in claim 1 wherein said product module includes at least one product support channel for positioning products therein, said at least one product channel being located adjacent at least one guide wall member extending between the respective front and rear wall portions thereof.

9. The product support module defined in claim 8 wherein said at least one product support channel includes track means extending therealong between the front and rear wall portions of said module for supporting products positioned thereon.

10. The product support module defined in claim 9 wherein said track means includes a plurality of spaced upstanding runners upon which products are supported for sliding movement therealong.

11. The product support module defined in claim 10 wherein the width of the individual track runners positioned adjacent to and in the vicinity of the front wall portion of said at least one product support channel is greater than the width of the individual track runners positioned adjacent to and in the vicinity of the rear wall portion thereof.

12. The product support module defined in claim 8 wherein said at least one product support channel includes spaced openings formed therethrough.

13. The product support module defined in claims 5, 6, or 8 wherein said guide wall members include means for allowing portions thereof to flex sidewardly to prevent binding of products located in said at least one product support channel.

14. The product support module defined in claim 8 wherein said at least one product support channel includes drain means for allowing product spillage to exit therethrough.

15. The product support module defined in claim 1 including a plurality of said product modules laterally interlocked together in side-by-side relationship to form a composite assembly for supporting products therein.

16. The product support module defined in claim 15 wherein said plurality of product support modules include modules which differ in width.

17. The product support module defined in claim 8 including a plurality of said product modules laterally coupled together to form a composite assembly, at least some of said plurality of product modules including modules having a different number of product support channels associated therewith.

18. The product support module defined in claim 15 including additional locking means associated with each of said modules for preventing inadvertent separation when two such modules are coupled together.

19. The product support module defined in claim 18 wherein said additional locking means includes at least one outwardly extending projection associated with one side edge portion of each of said modules and a corresponding recess associated with the opposite side edge portion of each of said modules, said recess being positioned and dimensioned to receive said projection when adjacent modules are coupled together.

20. The product support module defined in claim 1 wherein the stem portion associated with said rear keeper member is outwardly tapered along its entire length from its lower portion to its terminal end portion such that the mating surface between said stem portion and said overhanging flange portion forms an angle with the rear wall side portion of said product module.

21. The product support module defined in claim 20 wherein the thickness of the opposed wall portions forming the corresponding rear keying slot is thinner at their respective lower portions as compared to their respective upper end portions so as to be compatible with the taper associated with the stem portion of said rear keeper member.

22. A product support module adaptable for interlocking engagement with substantially similarly constructed modules to form a selectable width composite display assembly for merchandising products therefrom, said module comprising a floor member having front, rear and opposed side wall portions, cooperatively engageable means associated with said opposed side wall portions for enabling said module to be coupled together with a substantially similarly constructed module, said cooperatively engageable means including a plurality of elongated friction keeper members associated with one of said side wall portions of said product module and a plurality of corresponding keying slots associated with the opposite side wall portion thereof, said plurality of keeper members being positioned and located in opposed relationship with said corresponding keying slots and including at least a front keeper member and a rear keeper member, said plurality of keeper members being substantially T-shaped in cross-section and each including a stem portion and an overhanging flange portion, the stem portion associated with said front and rear keeper members having substantially parallel side edges and being tapered in a direction which extends outwardly away from the side wall portion of said product module along its entire length from its lower portion to its upper terminal end portion such that the thickness of said stem portion as measured in a direction perpendicular to the respective side wall portion of said product module is thinner at its lower portion as compared to its upper end portion, said corresponding front and rear keying slots being cut into the side wall portion of said product module such that the thickness of the opposed wall portions forming said corresponding front and rear keying slots is thinner at their respective lower portions as compared to their respective upper end portions, the taper associated with said front and rear keeper stem portions and the wall thickness variation associated with said corresponding front and rear keying slots enabling said slots to become progressively tighter as said slots are moved downwardly over said front and rear keeper stem portions.

23. The product support module defined in claim 22 including at least one intermediate keeper member positioned at an intermediate location between said front and rear keeper members on one side wall portion of said product module, and at least one intermediate keying slot positioned at an intermediate location between said front and rear keying slots on the opposite side wall portion of said product module.

24. The product support module defined in claim 23 wherein said at least one intermediate keeper member includes a stem portion and an overhanging flange portion, the stem portion associated with said at least one intermediate keeper member being outwardly tapered along its entire length from its lower portion to its upper terminal end portion such that the mating surface between said stem portion and said overhanging flange portion forms an angle with the side wall portion of said product module.

25. The product support module defined in claim 22 including means extending transversely across said product support module between the opposed side wall portions thereof at an intermediate location between said front and rear wall portions for weakening said product module whereby said module can be separated along said weakening means into separate front and rear portions.

26. The product support module defined in claim 22 wherein said product module includes at least one product support channel for positioning products therein, said at least one product channel being located between a pair of guide wall members extending between the respective front and rear wall portions thereof.

27. The product support module defined in 26 wherein said at least one product support channel includes track means extending therealong between the front and rear wall portions of said module for supporting products positioned thereon.

28. The product support module defined in claim 26 wherein said at least one product support channel includes spaced openings formed therethrough.

29. The product support module defined in claim 26 wherein said guide wall members include means for allowing portions thereof to flex sidewardly to prevent binding of products located in said at least one product support channel.

30. The product support module defined in claim 26 wherein said at least one product support channel includes drain means for allowing product spillage to exit therethrough.

31. The product support module defined in claim 22 including a plurality of said product modules laterally interlocked together in side-by-side relationship to form a composite assembly for supporting products therein.

32. The product support module defined in claim 31 wherein said plurality of product support modules include modules which differ in width.

33. The product support module defined in claim 26 including a plurality of said product modules laterally coupled together to form a composite assembly, at least some of said plurality of product modules including modules having a different number of product support channels associated therewith.

34. A product support module adaptable for interlocking engagement with substantially similarly constructed modules to form a selectable width composite display assembly for merchandising products therefrom, said module comprising a floor member having front and rear wall portions and opposed side edge portions, said front wall portion having a side portion associated respectively with each opposite end thereof, said rear wall portion having a side portion associated respectively with each opposite end thereof, said rear wall side portions extending partially along each respective opposite side edge portion of said floor member, a guide wall member extending between the front and rear wall side portions adjacent one side edge of said module, the opposite side edge portion of said product module being free of a guide wall member, said guide wall member and said floor member forming at least one product support area for positioning products thereon, said module including cooperatively engageable means associated with the respective side edge portions thereof, said cooperatively engageable means being located on each side edge portion of said module so as to engage similar means located on the respective side edge portions of substantially similarly constructed modules thereby enabling said modules to be coupled together adjacent each other, said cooperatively engageable means including a plurality of friction keeper members associated with one of said side edge portions of said product module and a plurality of corresponding keying slots associated with the opposite side edge portion thereof, said plurality of keeper members including at least a front keeper member and a rear keeper member, said front keeper member being positioned and located on the outer surface of one of said front wall side portions and said rear keeper member being positioned and located on the outer surface of one of said rear wall side portions, the corresponding keying slots for engaging said front and rear keeper members being located on the opposite front and rear wall side portions associated with the opposite side edge portion of said product module and each being cut into said corresponding front and rear wall side portions such that the thickness of the opposed wall portions forming said front and rear keying slots is thinner at their lower portion as compared to their upper end portion, said plurality of keeper members being substantially T-shaped in cross-section and each including a stem portion and an overhanging flange portion, the stem and the overhanging flange portions associated with said front and rear keeper members being inversely tapered relative to each other in a direction which extends outwardly away from the front and rear wall side portions of said product module along their entire lengths from their lower portions to their upper terminal end portions such that the mating surface between said stem portion and said overhanging flange portion forms an angle with the respective front and rear wall side portions of said product module, the tapers associated with said front and rear keeper stem and overhanging flange portions causing the thickness of said stem portion to be thinner at its lower portion as compared to its upper end portion and causing the thickness of said overhanging flange portion to be thicker at its lower portion as compared to its upper end portion, said front and rear overhanging flange portions extending beyond the side edge periphery of their corresponding stem portions so as to define a space adjacent said stem portions and between said overhanging flange portions and the corresponding front and rear wall side portions which is compatible for receiving the wall thickness variations associated with said front and rear keying slots thereby enabling adjacent modules to be drawn progressively closer together as said front and rear keying slots are moved progressively downwardly over said front and rear keeper stem portions.

35. The product support module defined in claim 34 including at least one intermediate keeper member and a corresponding keying slot positioned at respective intermediate locations between said front and rear keeper members and said front and rear keying slots, said at least one intermediate keeper member and its corresponding keying slot being located on the respective opposed outer side edge portions of said product module.

36. The product support module defined in claim 34 including a plurality of said product modules laterally interlocked together in side-by-side relationship to form a composite assembly for supporting products therein.

37. The product support module defined in claim 36 wherein said plurality of product support modules include modules which differ in width.

38. The product support module defined in claim 34 including a plurality of said product modules laterally coupled together to form a composite assembly, at least some of said plurality of product modules including modules having a different number of product support areas associated therewith.

39. The product support module defined in claim 34 including a separate guide wall member attachable to the side edge portion of said module having no guide wall member associated therewith, said separate guide wall member having means associated therewith for cooperatively engaging the particular coupling means associated with said module side edge portion for enabling said module to be coupled together with a substantially similarly constructed module.

40. A product support module adaptable for interlocking engagement with substantially similarly constructed modules to form a selectable width composite display assembly for merchandising products therefrom, said module comprising a floor member having front and rear wall portions and opposed side edge portions, a guide wall member extending between said front and rear wall portions adjacent one of said side edge portions of said module, the opposite side edge portion of said module being free of a guide wall member, said guide wall member and said floor member forming at least one product support area for positioning products thereon, cooperatively engageable means associated with the opposed side edge portions of said module, said cooperatively engageable means being located on each side edge portion so as to engage similar means on the respective side edge portions of substantially similarly constructed modules thereby enabling said modules to be coupled together adjacent one another, said cooperatively engageable means including a plurality of friction keeper members associated with one side edge portion of said product module and a plurality of corresponding keying slots associated with the opposite side edge portion thereof, said plurality of keeper members being positioned and located in opposed relationship with said corresponding keying slots and including at least a front keeper member and a rear keeper member, said front keeper member being located on the outer side surface portion of one end of said front wall, said front keeper member including a stem portion and an overhanging flange portion, the stem portion associated with said front keeper member being tapered in a direction which extends outwardly away from the outer side surface portion of said front wall along its entire length from its lower portion to its upper terminal end portion such that the thickness of said stem portion as measured in a direction perpendicular to the outer side surface portion of said front wall is thinner at its lower portion as compared to its upper end portion, the overhanging flange portion associated with said front keeper member defining a space adjacent the periphery of the front keeper stem portion between said front overhanging flange portion and the corresponding front wall side portion, said defined space being compatible for receiving said front keying slot and being narrower adjacent the lower portion of said front keeper stem portion as compared to adjacent the upper end portion thereof thereby enabling the corresponding front keying slot to become progressively tighter as said slot is moved downwardly over said front keeper stem portion.

41. The product support module defined in claim 40 wherein the thickness of the wall portion forming said corresponding front keying slot is similarly tapered from bottom to top so as to be compatible with the taper associated with the stem portion of said front keeper member, the taper associated with said front keying slot further enabling said slot to become progressively tighter as said slot is moved downwardly over said front keeper stem portion.

42. The product support module defined in claim 40 including at least one intermediate keeper member positioned at an intermediate location between said front and rear keeper members on one side edge portion of said product module, and at least one intermediate keying slot positioned at an intermediate location between said front and rear keying slots on the opposite side edge portion of said product module.

43. The product support module defined in claim 40 including a plurality of said product modules laterally interlocked together to form a composite assembly for supporting products therein.

44. The product support module defined in claim 40 wherein said plurality of product support modules include modules which differ in width.

45. The product support module defined in claim 40 including a plurality of said product modules laterally coupled together to form a composite assembly, at least some of said plurality of product modules including modules having a different number of product support areas associated therewith.

46. The product support module defined in claim 40 including a separate guide wall member attachable to the side edge portion of said module having no guide wall member associated therewith, said separate guide wall member having means associated therewith for cooperatively engaging the particular coupling means associated with said module side edge portion for enabling said module to be coupled together with a substantially similarly constructed module.

47. The product support module defined in claim 46 wherein said separate guide wall member includes weakening means for separating said guide wall member along said weakening means into at least two separate portions.

48. A product support module adaptable for interlocking engagement with substantially similarly constructed modules to form a selectable width composite display assembly for merchandising products therefrom, said module comprising a floor member having front, rear and opposed side wall portions, cooperatively engageable means associated with said opposed side wall portions for enabling said module to be coupled together with a substantially similarly constructed module, said cooperatively engageable means including a plurality of elongated friction keeper members associated with one of said side wall portions of said product module and a plurality of corresponding keying slots associated with the opposite side wall portion thereof, said plurality of keeper members being positioned and located in opposed relationship with said corresponding keying slots and including at least a front keeper member and a rear keeper member, said plurality of keeper members being substantially T-shaped in cross-section and each including a stem portion and an overhanging flange portion, the stem portion associated with said front and rear keeper members being outwardly tapered along its entire length from its lower portion to its upper terminal end portion such that the mating surface between said stem portion and said overhanging flange portion forms an angle with the respective side wall portion of said product module, the taper associated with said front and rear keeper stem portions causing the thickness of said stem portions to be thinner at their respective lower portions as compared to their respective upper end portions, the overhanging flange portions of said front and rear keeper members defining a space adjacent the respective outer peripheries of said front and rear keeper stem portions between said front and rear overhanging flange portions and said corresponding side wall portions, said defined space being narrower adjacent the lower portion of each of said front and rear keeper stem portions as compared to adjacent the upper end portion thereof thereby enabling adjacent modules to be drawn progressively closer together as said front and rear keying slots are moved downwardly over said front and rear keeper stem portions, said product module including at least one product support channel for positioning products therein, said at least one product support channel being located between a pair of guide wall members extending between the respective front and rear wall portions thereof, said guide wall members including means for allowing portions thereof to flex sidewardly to prevent binding of products located in said at least one product support channel.

* * * * *